US009153371B2

(12) United States Patent
Iwakura et al.

(10) Patent No.: US 9,153,371 B2
(45) Date of Patent: Oct. 6, 2015

(54) COIL DEVICE

(71) Applicant: TDK Corporation, Tokyo (JP)

(72) Inventors: Masaaki Iwakura, Tokyo (JP); Nobuo Kitajima, Tokyo (JP); Katsumi Kobayashi, Tokyo (JP); Satoshi Sinbo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 13/910,701

(22) Filed: Jun. 5, 2013

(65) Prior Publication Data

US 2013/0328654 A1 Dec. 12, 2013

(30) Foreign Application Priority Data

Jun. 8, 2012 (JP) ..... 2012-130695

(51) Int. Cl.

| | |
|---|---|
| ***H01F 27/30*** | (2006.01) |
| ***H01F 27/00*** | (2006.01) |
| ***H01F 27/32*** | (2006.01) |
| *H01F 5/02* | (2006.01) |

(52) U.S. Cl.

CPC ..... *H01F 27/006* (2013.01); *H01F 27/325* (2013.01); *H01F 2005/025* (2013.01)

(58) Field of Classification Search

CPC ..... H01F 27/325; H01F 2005/025; H01F 2005/022

USPC ..... 336/195, 196, 198, 199

See application file for complete search history.

(56) References Cited

U.S. PATENT DOCUMENTS

| | | | | | |
|---|---|---|---|---|---|
| 4,779,068 | A * | 10/1988 | Sakamoto et al. | ..... | 333/176 |
| 4,945,332 | A * | 7/1990 | Sakamoto et al. | ..... | 336/69 |
| 5,309,125 | A * | 5/1994 | Perkins et al. | ..... | 333/160 |
| 6,002,319 | A * | 12/1999 | Honma | ..... | 336/73 |
| 6,396,379 | B1 * | 5/2002 | Kondo et al. | ..... | 336/208 |
| 6,794,976 | B2 * | 9/2004 | Sigl | ..... | 336/170 |
| 7,398,589 | B2 * | 7/2008 | Younger et al. | ..... | 29/602.1 |
| 8,022,803 | B2 * | 9/2011 | Park et al. | ..... | 336/208 |
| 8,058,962 | B2 * | 11/2011 | Zeng et al. | ..... | 336/208 |
| 8,242,871 | B2 * | 8/2012 | Kobayashi et al. | ..... | 336/198 |
| 2003/0020582 | A1 * | 1/2003 | Naito et al. | ..... | 336/198 |

FOREIGN PATENT DOCUMENTS

| | | |
|---|---|---|
| JP | 2005-158927 A | 6/2005 |
| JP | 2006-108390 A | 4/2006 |

* cited by examiner

*Primary Examiner* — Alexander Talpalatski
*Assistant Examiner* — Joselito Baisa
(74) *Attorney, Agent, or Firm* — Arent Fox LLP

(57) ABSTRACT

A coil device 10 comprises a first bobbin 40 provided with a first winding part 45 at an outer circumference and a second bobbin 50 provided with a second winding part 55 at an outer circumference. A plurality of partition walls 46, separating portions of the wire 22 which are adjacent to each other along the scroll axis Z of the first wire 22 are formed on the first winding part 45 along the scroll axis at predetermined intervals. A section width w1 of each section 47, which is along the scroll axis Z, separated by the partition walls 46 is determined so that only one wire 22 can pass through. A height of the partition walls 46 is determined so that one or more of the wires 22 can pass through. At least one connecting groove 46*a*, connecting each section which are adjacent to each other, is formed on each partition wall 46.

8 Claims, 11 Drawing Sheets

COIL DEVICE

BACKGROUND OF THE INVENTION

1. Field of the Invention

The present invention relates to a coil device preferably used for a resonance transformer and the like.

2. Description of the Related Art

Coil devices are used in various electrical products for various uses. For instance, in a lighting circuit for a backlight of liquid crystal display, a leakage transformer, which is as a resonance transformer for driving a display device with higher voltages, is generally used.

For a leakage transformer, as shown in the following Reference 1 for instance, a horizontal-type coil device, to which a scroll axis of coil is arranged parallel to a mounting substrate surface of the coil device, is known. Such horizontal-type coil device has a problem that a leakage flux toward upward and downward directions with respect to the mounting substrate surface is large.

In order to make the leakage flux small, it is considered that top and bottom of the horizontal-type coil device is covered with aluminum board or aluminum foil. However, with this, heat dissipation may be deteriorated.

Further, for other leakage transformers, as shown in the following Reference 2 for instance, a vertical-type coil device, to which a scroll axis of coil is arranged perpendicular to a mounting substrate surface of the coil device, is known. With its configuration, it enables to make the leakage flux toward upward and downward directions with respect to the mounting substrate surface small.

However, for conventional coil devices, a primary coil and a secondary coil are composed of wires wound by normal regular winding. Particularly, for the secondary coil which produces a high voltage, there is a problem with voltage withstandability since the start of winding wire for a first layer and the end of winding wire for a second layer closely contact with each other, and the voltage differences between them get larger. Further, for the regular winding, it is a way to wind one wire in a spiral way for a first layer and then to wind back on the first layer from end to start of the first layer for a second layer. For the subsequent layers, the same process is applied.

Further, as the frequency of voltage applied to a coil device gets higher, there is a problem with the current flow since wires, which are adjacent to each other, exert effects on each other. Furthermore, for the coil devices used for a leakage transformer, it is important to stabilize leakage characteristics. However, for the conventional coil devices wherein wires are wound in regular winding, there is a problem with the stability of leakage characteristics.

[Reference 1] Japanese Published Unexamined Application No: 2006-108390

[Reference 2] Japanese Published Unexamined Application No: 2005-158927

SUMMARY OF THE INVENTION

The present invention has been made by considering the above circumstances, and a purpose of the present invention is to provide a coil device which is excellent in voltage withstandability and high frequency characteristics, and also excellent in stability of leakage characteristics.

In order to achieve the above purpose, a coil device according to the present invention comprises:

a first bobbin provided with a first winding part at an outer circumference to which a first wire composing either a primary coil or a secondary coil is wound; and a second bobbin mounted on the outer circumference of said first bobbin and provided with a second winding part at an outer circumference to which a second wire composing the other one of said primary coil or said secondary coil is wound, wherein a plurality of partition walls, separating portions of the wire which are adjacent to each other along the scroll axis of said first wire or said second wire, are formed on at least one of said first winding part or said second winding part along said scroll axis at predetermined intervals, a section width of each section, which is along said scroll axis, separated by said partition walls is determined so that only one said wire can pass through, a height of said partition walls is determined so that one or more of said wires can pass through, and at least one connecting groove, connecting the sections which are adjacent to each other, is formed on each partition wall.

For coil devices according to the present invention, when winding the wire in two layers or more around the winding part on which partition walls are formed, winding the wire in two layers or more in one section and then winding the wire in two layers or more in next section, and subsequently winding the wire in two layers or more by moving the wire to the next sections through the connecting grooves. Thus, the voltage differences among portions of the wire overlapping each other in each section are small. Further, portions of the wire which are adjacent to each other in a direction of the scroll axis are insulated by partition walls, and that result in improvement of voltage withstandability and also improvement of high frequency characteristics.

Furthermore, in each section, the wire is wound so that only a single cross-section of the wire exists along the direction of scroll axis. Therefore, it becomes easier to prevent fluctuations of the winding number of the wire per layer, and that results in stability of leakage characteristics. Specifically, it becomes easy to strictly control the coupling coefficient K between a primary coil and a secondary coil. Further, the coil device of the present invention can be favorably used as a leakage transformer.

Further, the coil device of the present invention can be used as a vertical-type coil device wherein a scroll axis of coil is arranged perpendicular to a mounting substrate surface of the coil device. Therefore, it is easy to cool a core which is inserted into a hollow portion of first bobbin.

Preferably, the first wire arranged at an inner circumference side composes said secondary coil which produces a high voltage compared with said primary coil, and a plurality of partition walls are formed along said scroll axis on said first winding part.

In this case, by arranging the secondary coil which produces a high voltage at an inner circumference of the primary coil which produces a relatively low voltage, it becomes easy to insulate. Further, in this case, for said second winding part, second wires may be wound in regular winding. This is because the second wire composes a primary coil and relatively low voltage is applied.

It is preferable that said second bobbin can be divided at a dividing line which is parallel to said scroll axis. With this configuration, it becomes easy to arrange second bobbin at the outer circumference of first bobbin.

A first overall width of said first winding part which is in a direction of said scroll axis may be different from a second overall width of said second winding part which is in a direction of said scroll axis. By making the first overall width different from the second overall width, it enables to adjust a leakage characteristic. Further, even if equalizing the overall width of the first winding part and the second winding part, by making the number of winding layer of the first winding part and the second winding part different, it enables to adjust a leakage characteristic.

It is preferable that said connecting grooves, which are respectively formed on said partition walls, are arranged so that they enable to communicate linearly along the direction of said scroll axis. Further, it is preferable that two or more of said connecting grooves are respectively formed on each of partition walls. Any one of connecting grooves can be used as a passage for the wire movement among sections, and the other one of connecting grooves can be used as a passage that enables the start end of winding wire or final end of winding wire to lead to the terminal which is formed on one end of the scroll axis. If the passage for leading is linear, it enables to connect the end of the wire to the terminal by the most direct way.

At least one of said partition walls may be contacted with the inner surface of said second bobbin so as to align a position of said first winding part and said second winding part approximately concentrically. In this case, there is no need to apply extra members to align the positions of the first bobbin and the second bobbin.

DESCRIPTION OF THE PREFERRED EMBODIMENTS

Figure 1:
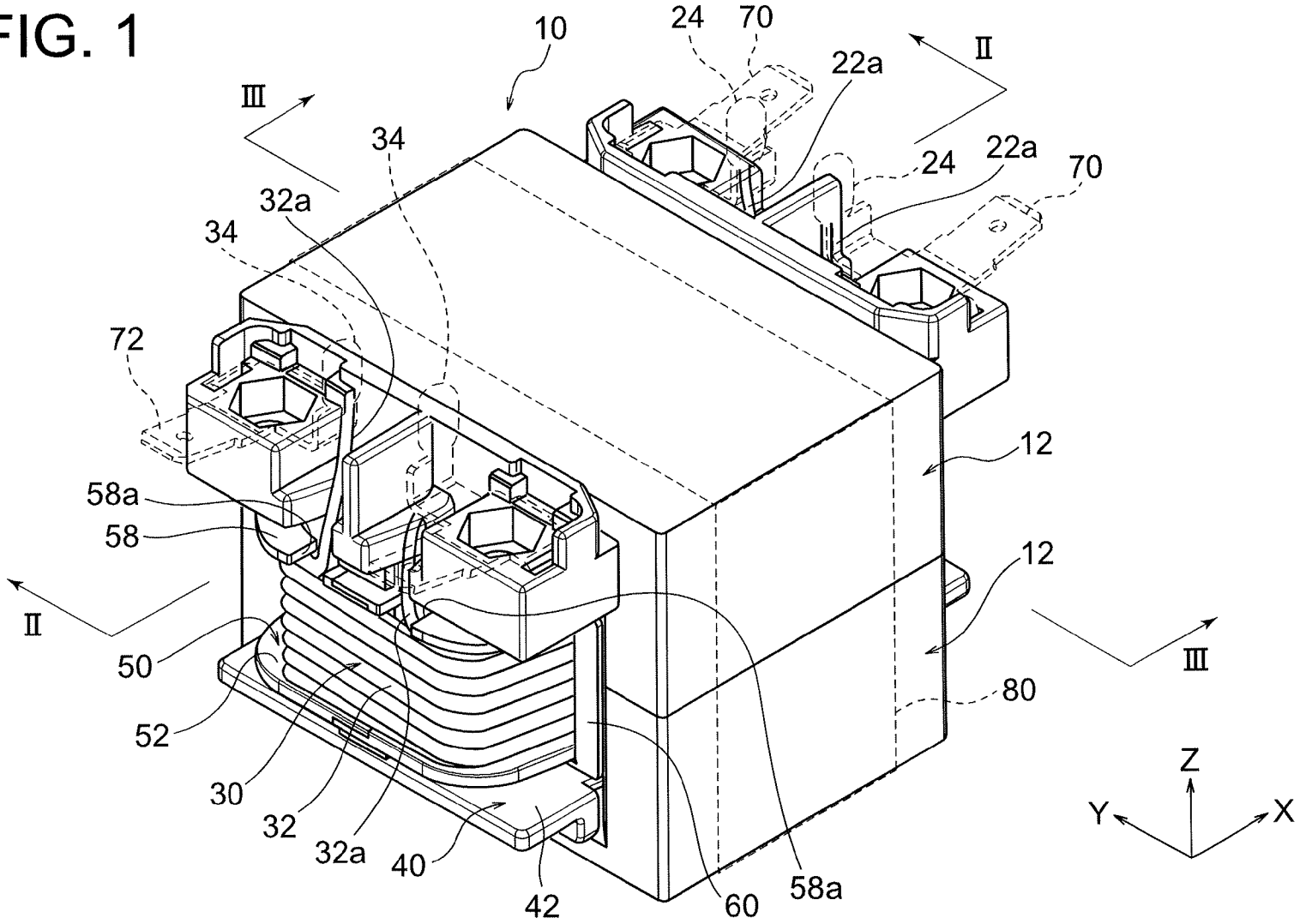
FIG. 1 is a perspective view of coil device according to an embodiment of the present invention.

The followings are the explanation of the present invention based on embodiments shown in FIGS.

First Embodiment

As shown in FIGS. 1 to 4, coil device 10 according to one embodiment of the present invention comprises core 12, first bobbin 40 and second bobbin 50.

The core 12 of the coil device 10 forms a magnetic path where magnetic flux generated from coil, which is described later, passes. It is formed by assembling a pair of cores 12, 12 which are separately formed. These cores 12 have a symmetrical shape, and they are attached to each other, sandwiching the second bobbin 50 and the first bobbin 40 from upward and downward directions (Z-axis direction in FIG. 1).

Figure 3:
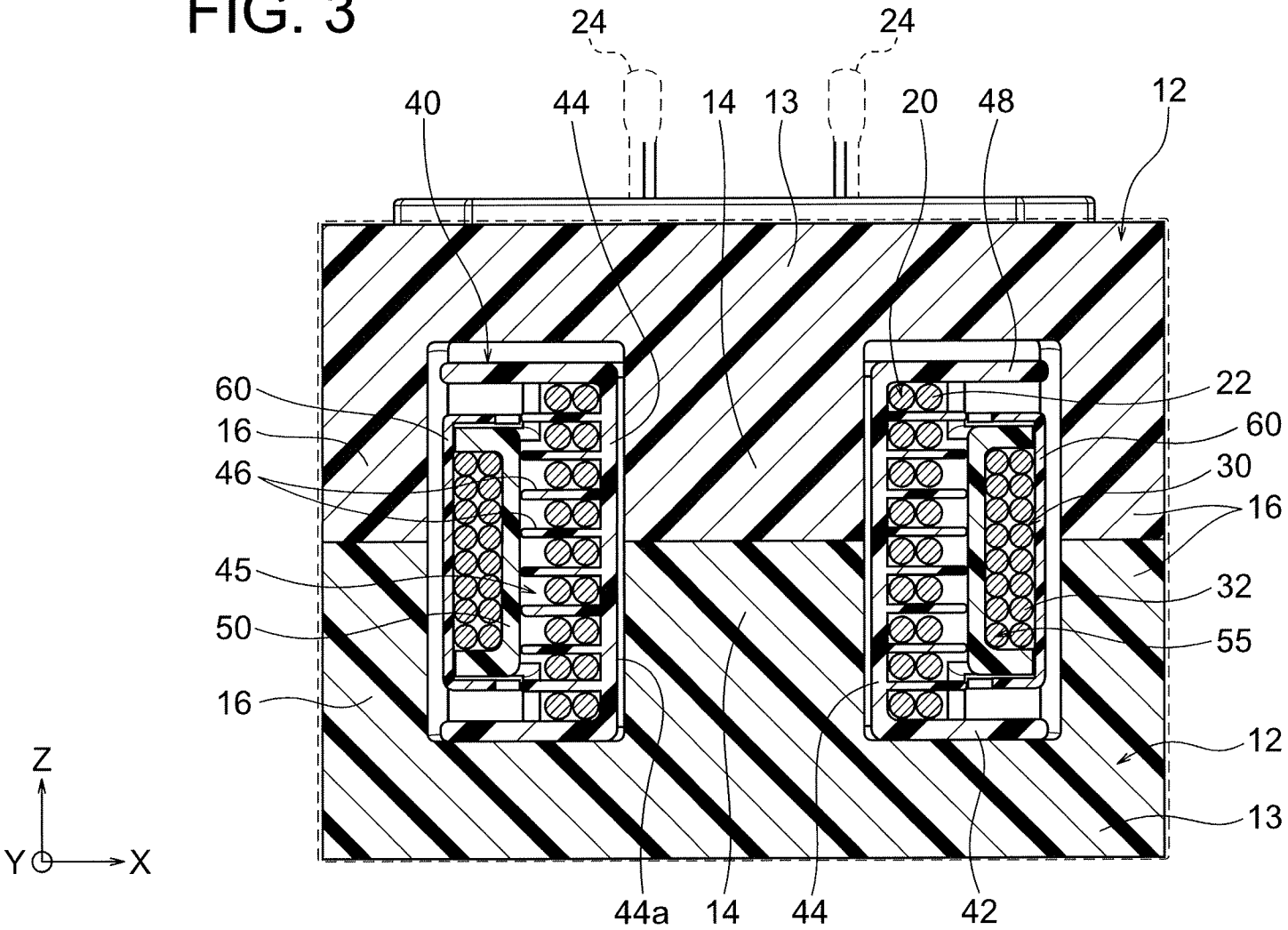
FIG. 3 is a cross-sectional view of the essential parts, taken along the line III-III in FIG. 1.

As shown in FIG. 3, each core 12, 12 has an approximately E-shaped vertical cross-section (cut section including Y-axis and Z-axis). Each core 12, 12 is composed of ferrite core and comprises planar base portions 13, 13 extending in the Y-axis direction, a pair of side legs 16, 16 projecting from both ends of Y-axis direction of each base portions 13, 13 to the Z-axis direction, and middle legs 14, 14 projecting from an intermediate position of Y-axis direction of each base portions 13, 13 to the Z-axis direction.

Figure 4:
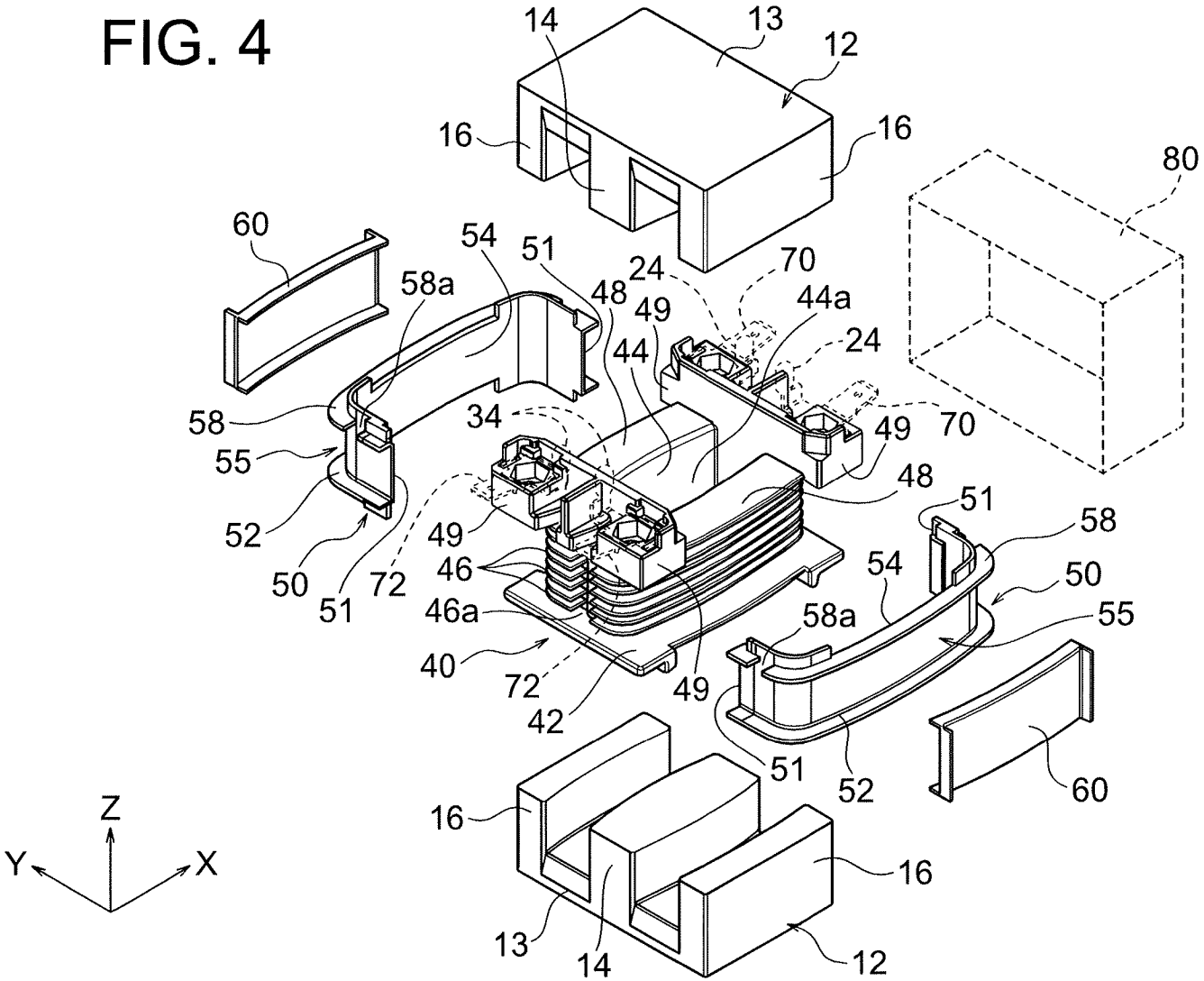
FIG. 4 is an exploded perspective view of coil device shown in FIG. 1.

Further, in Figures, Z-axis shows a height direction of the coil device 10, and it enables low height profile of the coil device as the height of Z-axis direction of the coil device 10 becomes lower. Furthermore, Y-axis and Z-axis are perpendicular to each other and also perpendicular to Z-axis. In this embodiment, as shown in FIG. 4, X-axis corresponds to a longitudinal direction of bobbins 40 and 50, and Y-axis corresponds to a longitudinal direction of base portions 13, 13 of ferrite core 12.

First bobbin 40 comprises an approximately rectangular planar first bobbin plate 42. A bottom side of first bobbin plate 42 is a mounting surface (mounting substrate surface) of the coil device. On an approximately intermediate position of the first bobbin plate 42, as shown in FIGS. 2 and 3, a first hollow cylinder 44 is integrally formed extending to the upper side of the Z-axis direction.

On the upper side of the Z-axis direction of the first hollow cylinder 44, the first bobbin upper collar part 48 is integrally formed projecting, along the plane of the Y-X axis, from the first hollow cylinder 44 in a radial direction. At the four corners of the first bobbin upper collar part 48, a terminal block 49 is integrally formed, and each pair of first terminals 70 and 72 can be removably attached.

These terminals 70 and 72 are composed of, for instance, metal terminals. As will hereinafter be described, on the first terminal 70, a lead part 22*a* (refer to FIGS. 1 and 2) of first wire 22 composing inner coil 20 that serves as a secondary coil is connected through a solder portion 24. Further, on the second terminal 72, a lead part 32*a* (refer to FIG. 1) of second wire 32 composing outer coil 30 which serves as a primary coil is connected through a solder portion 34.

Figure 2:
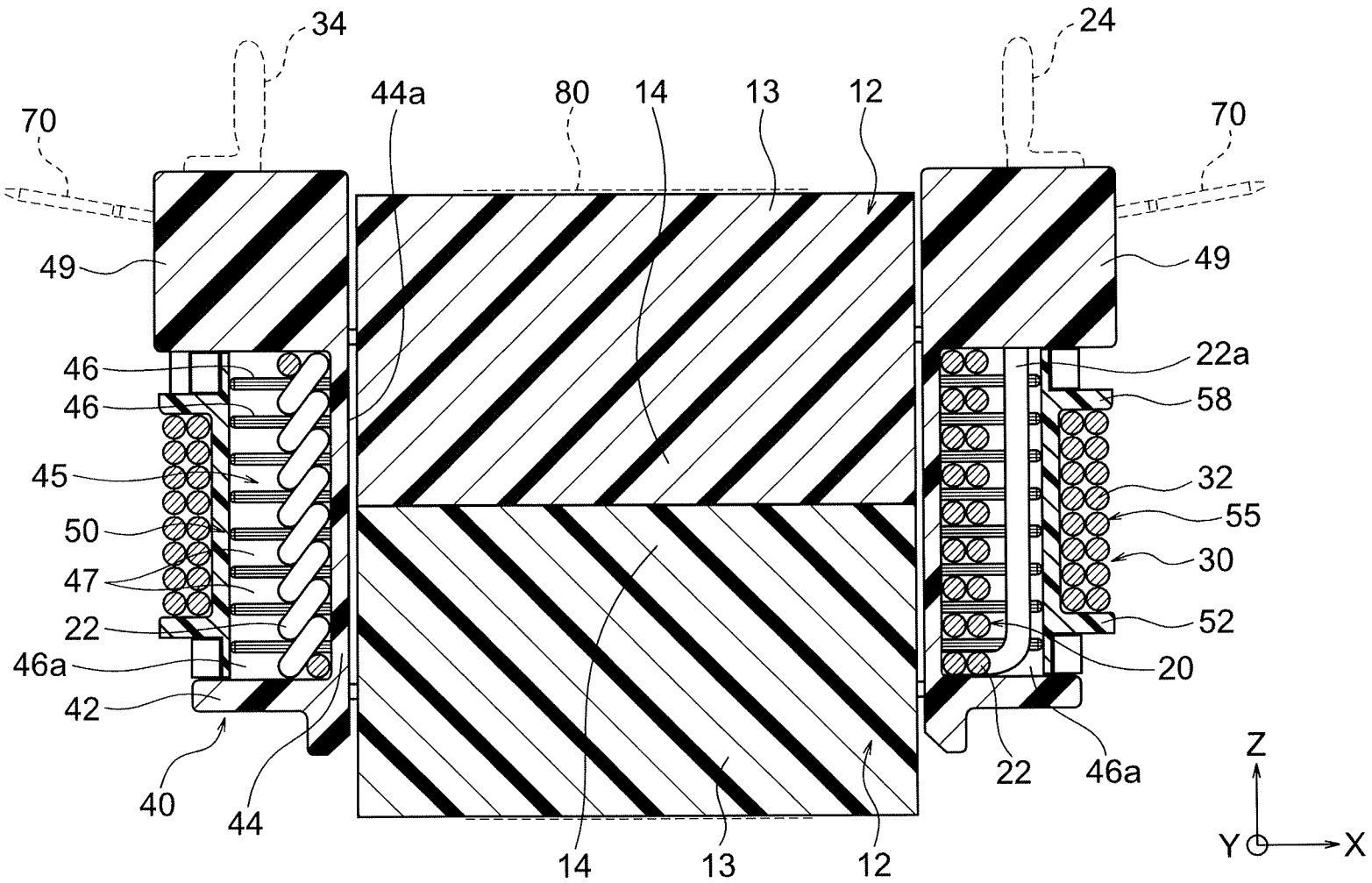
FIG. 2 is a cross-sectional view of the essential parts, taken along the line II-II in FIG. 1
Figure 5:
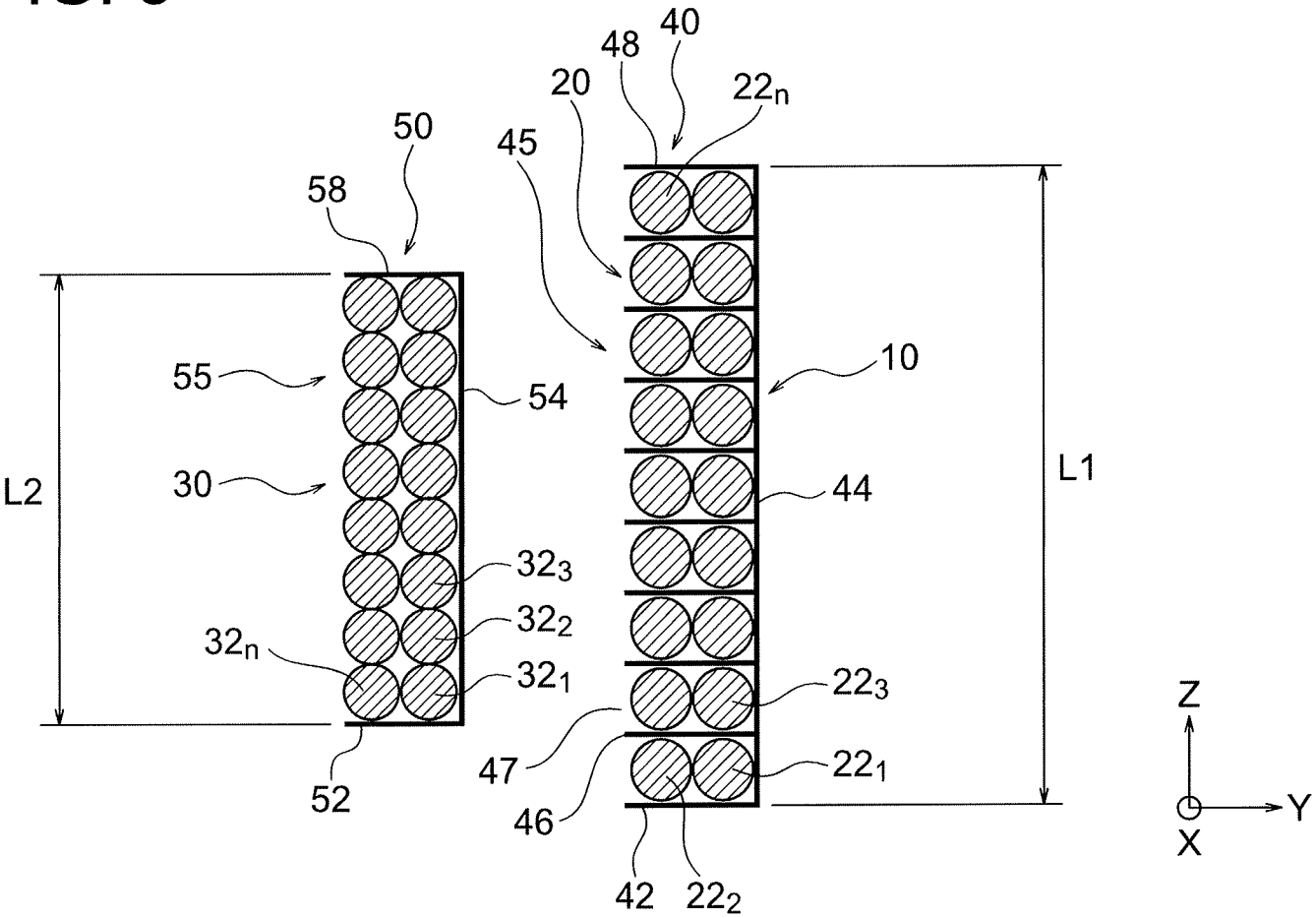
FIG. 5 is a schematic view showing the relation between a primary coil and a secondary coil of coil device shown in FIG. 1.

As shown in FIGS. 2, 3 and 5, a first winding part 45 is formed at an outer circumference of the first hollow cylinder 44 which is located between the first bobbin upper collar part 48 and the first bobbin plate 42. On the first winding part 45, a plurality of partition walls 46, separating portions of the wire which are adjacent to each other along the scroll axis (Z-axis) of the first wire 20, are formed integrally with the first hollow cylinder 44, which are parallel to the first bobbin upper collar part 48 along the scroll axis at predetermined intervals.

It is preferable that first bobbin plate 42, first hollow cylinder 44, first bobbin upper collar part 48, terminal block 49 and partition walls 46 of first bobbin 40 are integrally formed by an injection molding and the like.

A first through hole 44*a*, penetrating in the Z-axis direction, is formed inside the first hollow cylinder 44 of the first bobbin plate 42. Middle legs 14 of core 12 enter into the first through hole 44*a* from upward and downward of the Z-axis directions, and tip ends of middle legs 14 contact with each other at an approximately intermediate position of the Z-axis direction of the through hole 44*a*.

As shown in FIG. 4, second bobbin 50 is combined along a dividing line 51 which is parallel to the scroll axis (Z-axis) and is divisible into two. Further, a second winding part 55 is formed at an outer circumference of the second bobbin 50. Note that coils 20 and 30 are abbreviated in FIG. 4. The second bobbin 50 is mounted on the outer circumference of first bobbin 41 and combined along the dividing line 51, after the first wire 22 is wound around the first winding part of first bobbin 40 to form the inner coil 20.

Second bobbin 50 comprises a second hollow cylinder 54 which covers the inner coil 20 from outside. Further, on the outer circumference of the second hollow cylinder 54, a second bobbin lower collar part 52 and a second bobbin upper collar part 58 are formed, along the circumferential direction, in the Z-axis direction at predetermined intervals. The lower collar part 52 and the upper collar part 58 are provided parallel to the plane of the X-Y axis, extending parallel to the mounting surface.

The second winding part 55 is located between the lower collar part 52 and the upper collar part 58. As shown in FIG. 5, the second wire 32 ($\mathbf{32}_1$ to $\mathbf{32}_n$) composing outer coil 30 which serves as a primary coil is wound by regular winding around this second winding part 55. For the regular winding, it is a way to wind the wire for a first layer and then subsequently wind the wire for a second layer. With this, a wire portion $\mathbf{32}_1$ which is the start end of winding wire for a first layer and a wire portion $\mathbf{32}_n$ which is the final end of winding wire overlap.

In the present embodiment, by changing a forming position and a forming interval of the upper collar part 52 and the lower collar part 58 which are formed on the outer circumference of the second hollow cylinder 54 of second bobbin 50, it enables to shorten the second overall width L2 of the second winding part 55 in a direction of scroll axis compared with the first overall width L1 of the first winding part 45 in a direction of scroll axis, as shown in FIG. 5.

As shown in FIGS. 3 and 4, at an outer circumference of second winding part 55 of second bobbin 50 to which an outer coil 30 is attached, a pair of insulative cover members 60 is attached from both sides of the Y-axis direction. The insulative cover members 60 are composed of, for instance, synthetic resins. The outer surface of the insulative cover member serves as a guiding surface which guides side legs 16 of core 12. Further, at the inner surface of the insulative cover member, the outer coil 30 is located.

As shown in FIG. 4, at two points of the upper collar part 58 of second bobbin 50 in a circumferential direction, notches 58*a* for the lead insertion are formed at a position corresponding to the second terminals 72. As shown in FIG. 1, a lead part 32*a* which is the start end or the final end of winding second wire 32 is inserted into the notches 58*a* to connect to the second terminal 72 at a solder portion 34.

Second bobbin 50, which is divisible into two parts, comprising collar parts 52, 58 and second hollow cylinder 54 is integrally formed by an injection molding and the like. Further, cover member 60 can also be formed by an injection molding and the like.

Figure 6:
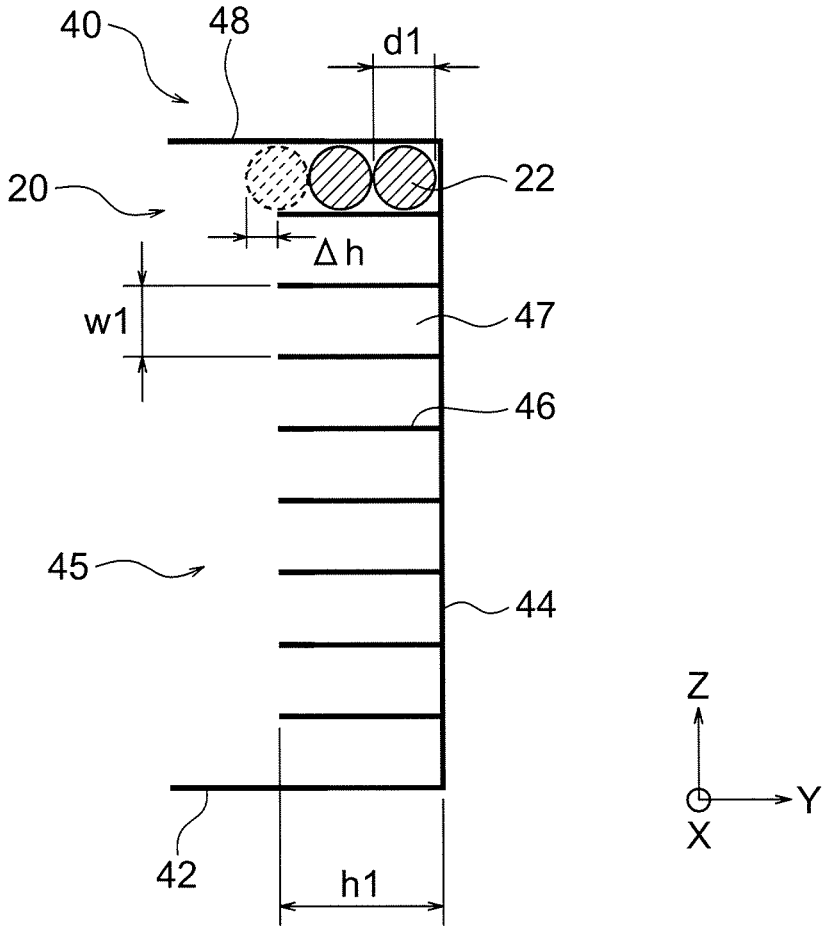
FIG. 6 is a schematic view showing measurements of partition walls shown in FIG. 5.

As shown in FIGS. 5 and 6, in the present embodiment, a section width w1 of each section 47, which is along the scroll axis (Z-axis), separated by partition walls 46 is determined so that only one wire 22 ($\mathbf{22}_1$ to $\mathbf{22}_n$) can pass through. Specifically, it is preferable that the section width w1 satisfies the relation of w1<(2×d1) with respect to a wire diameter d1 of the wire 22. If the section width w1 is too wide with respect to the wire diameter d1, it might become difficult to wind only one wire for each section 47 in a direction of the scroll axis.

It is preferable that a height h1 of each partition wall 46 is higher than m×d1, if the total number that the wire will be wound for each section 47 is represented by "m". With that, as shown in FIGS. 3 and 4, a top of partition wall 46 can be contacted with the inner surface of the second bobbin 50 to align the positions of the first winding part 45 and the second winding part 55 approximately concentrically. Further, there is no need to apply extra members to align the positions of the first bobbin 40 and the second bobbin 50.

Note that it is not necessary to contact the tops of all partition walls 46 with the inner surface of the second bobbin 50. The height of any one of partition walls, preferably two or more of the partition walls separating in a direction of the scroll axis may be set higher than the other partition walls to align the position, so that only those tops of partition walls contact with the inner surface of second bobbin 50. Alternatively, the positions of the first bobbin 40 and the second bobbin 50 may be aligned by members other than partition walls 46.

In such case, as shown with a dashed line in FIG. 6, the height h1 of the partition walls 46 may be shorter than m×d1. However, it is preferable that the height Δh (=m×d1−h1) of projecting part is shorter than d1/2 so that the wire 22 does not move to the next section 47. Further, it is preferable that the protruding height of the first bobbin plate 42 and the collar part 48 is higher than the height of the partition walls 46.

The first wire 22 may be composed of a single wire, or may be composed of a strand wire. Further, it is preferable that the first wire 22 is composed of an insulating coating conductive wire. Although the outer diameter d1 of the wire 22 is not particularly limited, for instance, ϕ1.0 to ϕ3.0 mm is preferable when applying high current. For the second wire 32, it may be the same with the first wire 22. However, it may also be different from the first wire 22.

In this embodiment, high current is applied to the first wire 22 to compose a secondary coil of transformer. Therefore, the wire diameter of the first wire 22 is made larger compared with the second wire 32. However, the wire diameter is not particularly limited. It may be the same with the second wire 32, or conversely, it may also be different from the second wire 32. Further, for the materials of the first wire 22 and the second wire 32, they may be the same with each other, or they may also be different from each other.

In the present embodiments as shown in FIG. 5, in the first bobbin 40, two windings ($\mathbf{22}_1$ and $\mathbf{22}_2$) of the first wire 22 ($\mathbf{22}_1$ to $\mathbf{22}_n$) are wound for the section 47 which is located at the lowest part of the Z-axis direction, and then the wire $\mathbf{22}_3$ for the third winding is wound for the next section 47 located above the lowest part. Subsequently, the same process is applied, and the final end $\mathbf{22}_n$ of winding the first wire 22 is at the section 47 located at the top of the Z-axis direction, which is the furthest away from the start end of winding the wire $\mathbf{22}_1$.

On the other hand, as previously mentioned, in the second bobbin 50, the second wire 32 ($\mathbf{32}_1$ to $\mathbf{32}_n$) compositing the outer coil 30 which serves as a primary coil is wound by regular winding around the second winding part 55. For the regular winding, it is a way to wind the wire for a first layer and then subsequently wind the wire for a second layer. With this, the wire $\mathbf{32}_1$ which is the start end of winding wire for a first layer and the wire $\mathbf{32}_n$ which is the final end of winding wire overlap. In the present embodiment, the outer coil 30 composes a primary coil of transformer. Therefore, the outer coil has a low voltage compared with the inner coil 20 which serves as a secondary coil, and there are no problems with the regular winding.

As shown in FIGS. 1 and 2, in the first bobbin 40, at both sides of the X-axis direction of each partition wall 46 which are successive in a circumferential direction, a pair of connecting grooves 46 linearly extending in the Z-axis direction is formed. As shown in FIG. 2, one of the pair of connecting grooves 46*a* is used for moving the wire 22 among adjacent section 47. Further, the other one of the connecting grooves 46*a* is used for guiding a lead part 22*a* of the wire 22 which is the start or the final end of winding to the direction of solder portion 24 of terminals 70.

Coil device 10 according to the present embodiment is produced by assembling each part shown in FIG. 4 and by winding wires around the first bobbin 40 and the second bobbin 50. Below is the explanation about an example of producing method of coil device 10 by use of FIG. 4 and so on. When producing coil device 10, firstly, a first bobbin 40 provided with a first terminal 70 and a second terminal 72 is prepared. Although the materials for the first bobbin 40 are not particularly limited, the first bobbin 40 is formed by insulating materials such as resins.

Next, the first wire 22 is wound around the outer circumference of first hollow cylinder 44 of first bobbin 40 to form the inner coil 20. Although the first wire 22 used to form the inner coil 20 is not particularly limited, litz wire and the like are preferably used. Further, a lead part 22*a* which is a terminal portion of the first wire 22 when forming the inner coil 20 is tangled with a part of the first terminal 70 and soldered to connect.

Next, the second bobbin 50 is mounted on the first bobbin 40 wherein the inner coil 20 is formed. At the outer circumference of the second hollow cylinder 54 of the second bobbin 50, the second wire 32 composing the outer coil 30 is wound.

After that, a cover 60 is attached to both sides of the Y-axis direction of the second bobbin 50, and then core 12 is mounted from upward and downward directions of the Z-axis direction. Specifically, tip ends of middle legs 14, 14 and tip ends of side legs 16, 16 of core 12 are connected together. Further, there may be a gap between tip ends of middle legs 14, 14.

As for a material of core 12, although soft magnetic materials such as metal, ferrite and the like are exemplified, it is not particularly limited. The core 12 is fixed to the second bobbin 50 and the first bobbin 40 by applying a bonding adhesive or by winding its outer circumference with a tape-shaped member 80. Further, after the series of assembling process, varnish impregnation may be performed to coil device 10. With these processes, coil device 10 according to the present embodiment can be produced.

Coil device 10 is a vertical type, wherein the Z-axis direction (flux flowing direction) of middle legs 14 is vertical to the mounting surface. For the vertical type of coil device 10, base portions 13, 13 of core 12 are placed upward and downward directions of the Z-axis of coils 20, 30, and that these base portions 13, 13 suppress leakage flux toward upward and downward directions. Therefore, leakage flux of coil device 10 upward and downward directions can be suppressed effectively, compared to a horizontal type wherein upward and downward directions of coil are hardly shielded by core.

Therefore, the coil device 10 can prevent occurrence of eddy currents on surrounding constructional materials and the like, without implementing aluminum shield and the like. Further, the coil device 10 can decrease occurrence of heat and noise associated with the occurrence of eddy current.

Further, the coil device does not require a shield to shield leakage flux, and therefore it can obtain a favorable heat dissipation characteristic. Furthermore, the coil device 10 provides short length middle leg 14 and side legs 16, 16 of core 12, and that enables to prevent damages of core 12 caused by external impact and the like.

Further, for a tape-shaped member 80, it is preferable that it is composed of materials excellent in pyroconductivity, and more preferably excellent in insulation characteristics. Specifically, for a tape-shaped member 80, it is composed of, for instance, metals such as aluminium, copper and stainless, or alloys thereof, or resin materials excellent in pyroconductivity such as PPS resin.

Further, in the present embodiment, the combination of the first bobbin 40 and the second bobbin 50 is covered from the outside by respective base portions 13, 13 and side legs 16, 16 of core 12. With this structure, it enables to prevent leakage flux. The X-axis direction width of base portions 12, 12 and side legs 16, 16 may be the same or different, with respect to the X-axis direction length of middle legs 14, 14 of core 12. However, by making them approximately the same, it enables easily to adjust leakage characteristics.

For the coil device 10 according to the present embodiment, as shown in FIG. 5, when winding the first wire 22 in two layers or more around the first winding part 45 on which partition walls are formed, winding the wire in two layers or more in each section 47 and then winding the wire in two layers or more in the next section 47. Further, as shown in FIG. 2, the wire 22 is wound in two layers or more subsequently by moving it to the next sections 47 through the connecting grooves 46*a*. Thus, as shown in FIG. 5, the windings of the first wire 22 overlapping in each section 47 are close to each other. Therefore, a voltage difference between them is small. Further, the wires which are adjacent to each other in a direction of the scroll axis (Z-axis) are insulated by the partition walls 46, and that result in improvement of voltage withstandability and also improvement of high frequency characteristics.

Further, in each section 47, the wire 22 is wound so that only a single wire $\mathbf{22}_1$ to $\mathbf{22}_n$ exists along the direction of the scroll axis. With this, it becomes easier to prevent fluctuations of the winding number of the wire 22 per layer, and that results in stability of leakage characteristics. Specifically, it becomes easy to strictly control the coupling coefficient K between the outer coil 30 composing a primary coil and the inner coil 20 composing a secondary coil. With that, the coil device 10 of the present embodiment can be favorably used as a leakage transformer.

Further, the coil device 10 of the present embodiment can be used as a vertical-type coil device, to which a scroll axis of coil is arranged perpendicular to a mounting substrate surface of the coil device. Therefore, it is easy to cool a core 12 which is inserted into a hollow portion of the first bobbin 40.

Furthermore, in the present embodiment, the first wire 20 arranged at the inner circumference composes a secondary coil (inner coil 20) which produces a high voltage, compared with the primary coil of the transformer. With this, it becomes easy to insulate by arranging the secondary coil (inner coil 20) which produces a high voltage at the inner side of the primary coil (outer coil 30) which produces a relatively low voltage. Further, for the second winding part 55, the second wire 32 is wound by normal regular winding. However, there are no problems with that since the second wire 32 composes the outer coil 30 which serves as a primary coil to which a relatively low voltage is applied.

Moreover, in the present embodiment, as shown in FIG. 4, the second bobbin 50 can be divided at a dividing line 51 which is parallel to the scroll axis. Therefore, it enables easily to arrange the second bobbin 50 at an outer circumference of the first bobbin 40.

In addition, in the present embodiment, as shown in FIG. 5, by making a first overall width L1 of the first winding part 45 in a direction of the scroll axis different from a second overall width L2 of the second winding part 55 in a direction of the scroll axis, it enables easily and exactly to adjust leakage characteristics.

Further, in the present invention, although connecting grooves 46*a* respectively formed on the partition walls 46 are not necessarily arranged linearly along the direction of the scroll axis, it is preferable that they are arranged to communicate linearly as shown in FIG. 4. Particularly, if the connecting grooves 24*a* serve as a passage for leading the lead part 22*a* is linear in the Z-axis direction, it enables to connect the end of lead part 22*a* of the wire 22 to the terminal 70 by the most direct way. Further, by forming the connection grooves 24*a* for leading the wire 22 from each section 47 to the next sections 47 on each partition wall 46 at the same position in a circumferential direction, the winding process of the wire 22 becomes easy.

Second Embodiment

Figure 7:
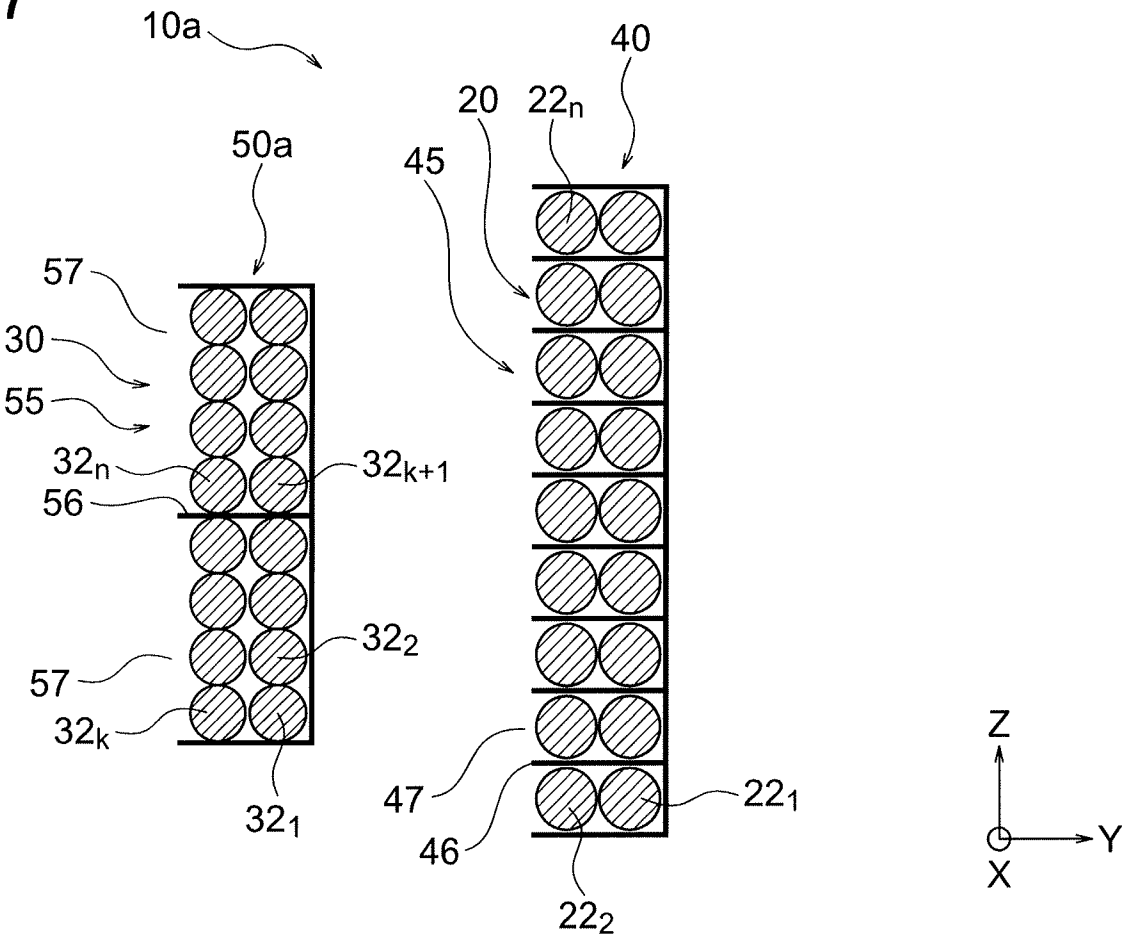
FIG. 7 is a schematic view showing the relation between a primary coil and a secondary coil of coil device according to other embodiments of the present invention.
Figure 8:
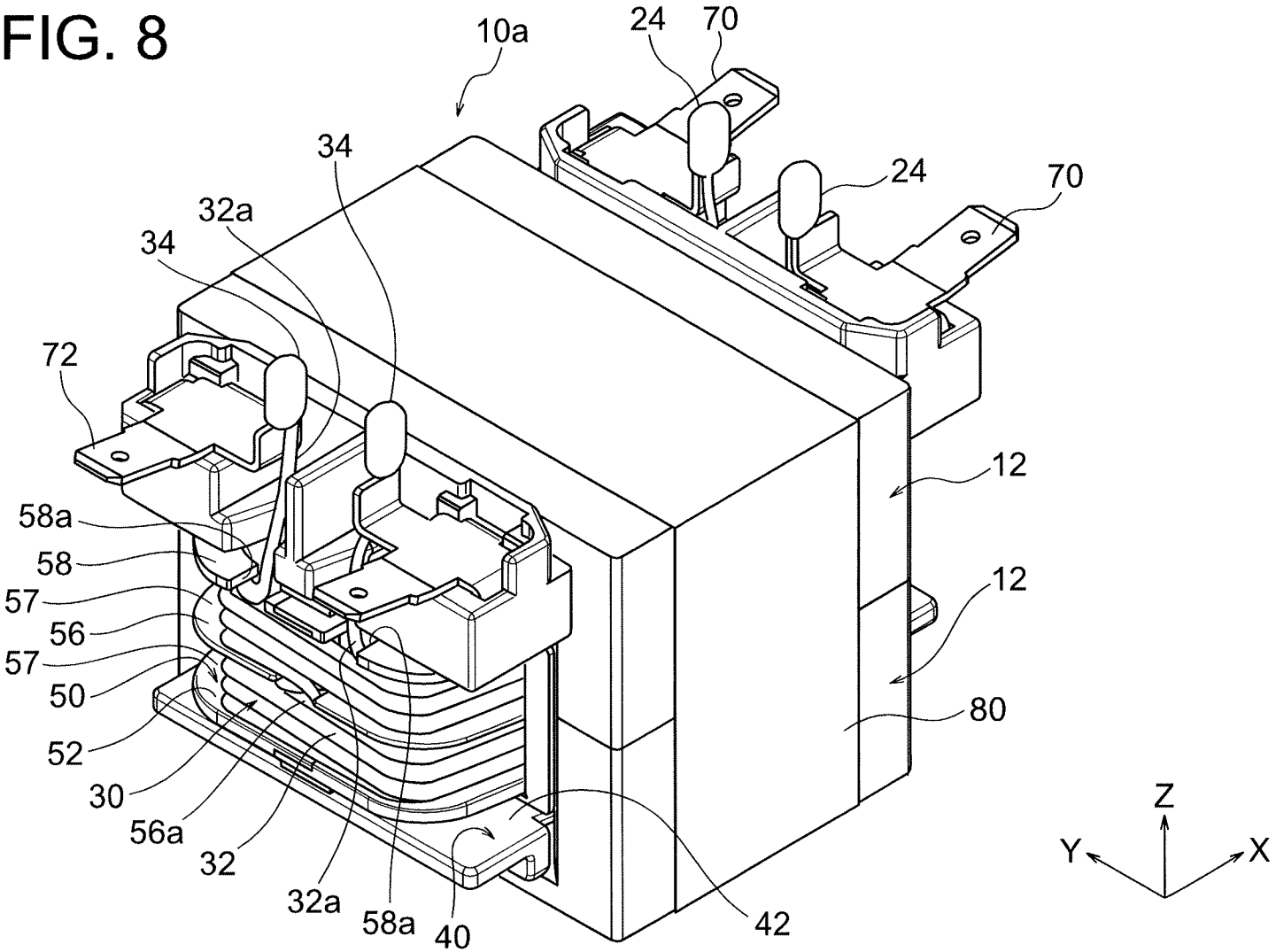
FIG. 8 is an overall perspective view of coil device according to the embodiment shown in FIG. 7.

For the coil device 10*a* according to the second embodiment shown in FIGS. 7 and 8, only the configuration of second bobbin 50*a* differs, compared with the coil device according to the first embodiment shown in FIGS. 1 to 6. However, for the other respects of the coil device 10*a*, they are the same with the first embodiment. The followings are the explanation about the differences between the first embodiment and the second embodiment.

In this coil device 10*a*, one or more of partition walls 56 are formed in the middle of the second bobbin in a direction of the scroll axis, and they divide the second winding part 55 into two or more sections 57 along the direction of the scroll axis. In each section 57, the second wires $\mathbf{32}_1$ to $\mathbf{32}_k$ and $\mathbf{32}_{k+1}$ to $\mathbf{32}_n$ are wound by regular winding. On each of the partition walls 56, connecting grooves 56*a* are formed one or more in the circumferential direction. The connecting grooves 56*a* function similarly with the connecting grooves 46*a*.

In the coil device 10*a* of this embodiment, it enables to separately arrange the outer coil 30 which composes a primary coil. Further, the primary coil which is separately arranged for each section 57 may be an independent separated coil respectively composed of different wires.

Other Embodiments

Figure 9A:
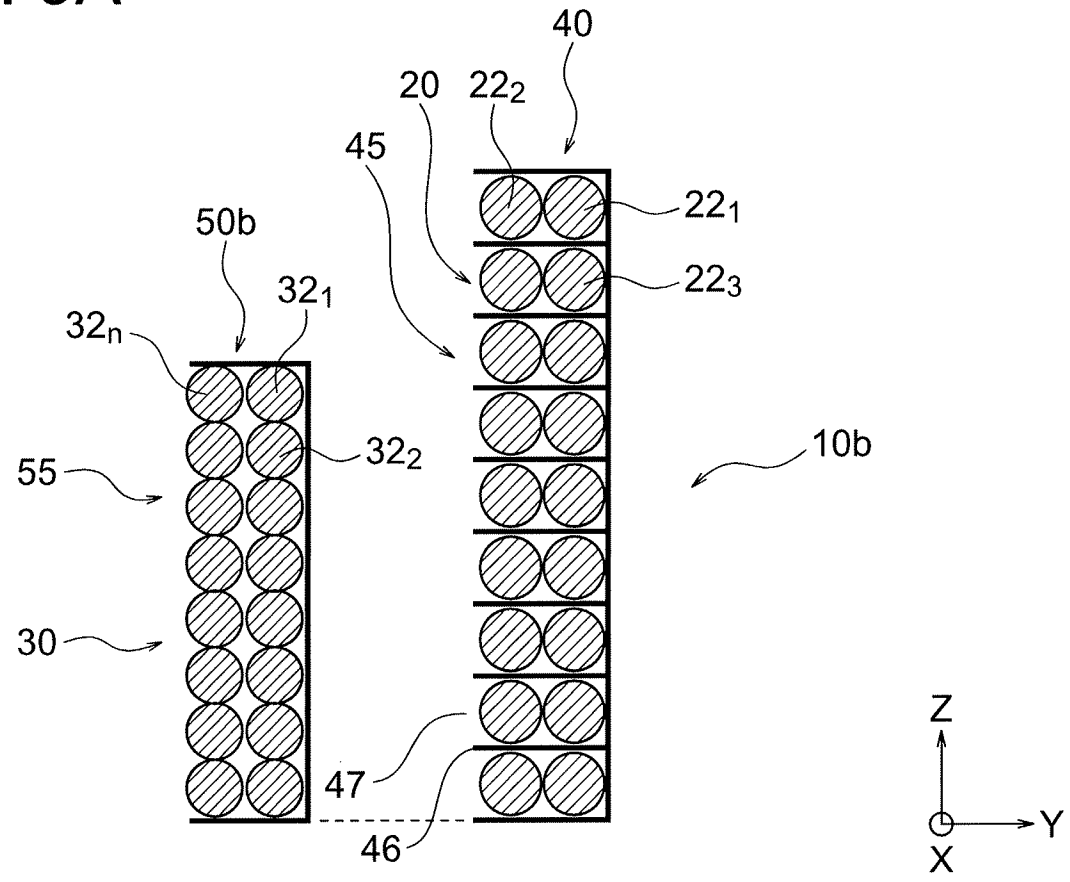
FIG. 9A is a schematic view showing the relation between a primary coil and a secondary coil of coil device according to another embodiments of the present invention.

In the first embodiment, as shown in FIG. 5, the center position of the second winding part 55 in a direction of the scroll axis is aligned with the center position of the first winding part 45 in a direction of the scroll axis. However, in addition to that, it may be configured as shown in FIG. 9A. In the coil device 10*b* according to this embodiment, the lower end of the second winding part 55 may be aligned with the lower end position of the first winding part 45 in a direction of the scroll axis.

With this, the effects of heat dissipation from coils 20 and 30 can be expected. The reason is that the heat transfer characteristics of not only coil 20 but also of coil 30 are improved by providing heat dissipation parts at the lower end of the coil device 10*b*. Further, in the embodiment shown in FIG. 9A, although the first wire 22 ($\mathbf{22}_1$ to $\mathbf{22}_n$) is wound from the upper end of the scroll axis, it may be wound from the lower end. For the other configuration and function effects, they are the same with the coil device according to the first embodiment.

Figure 9B:
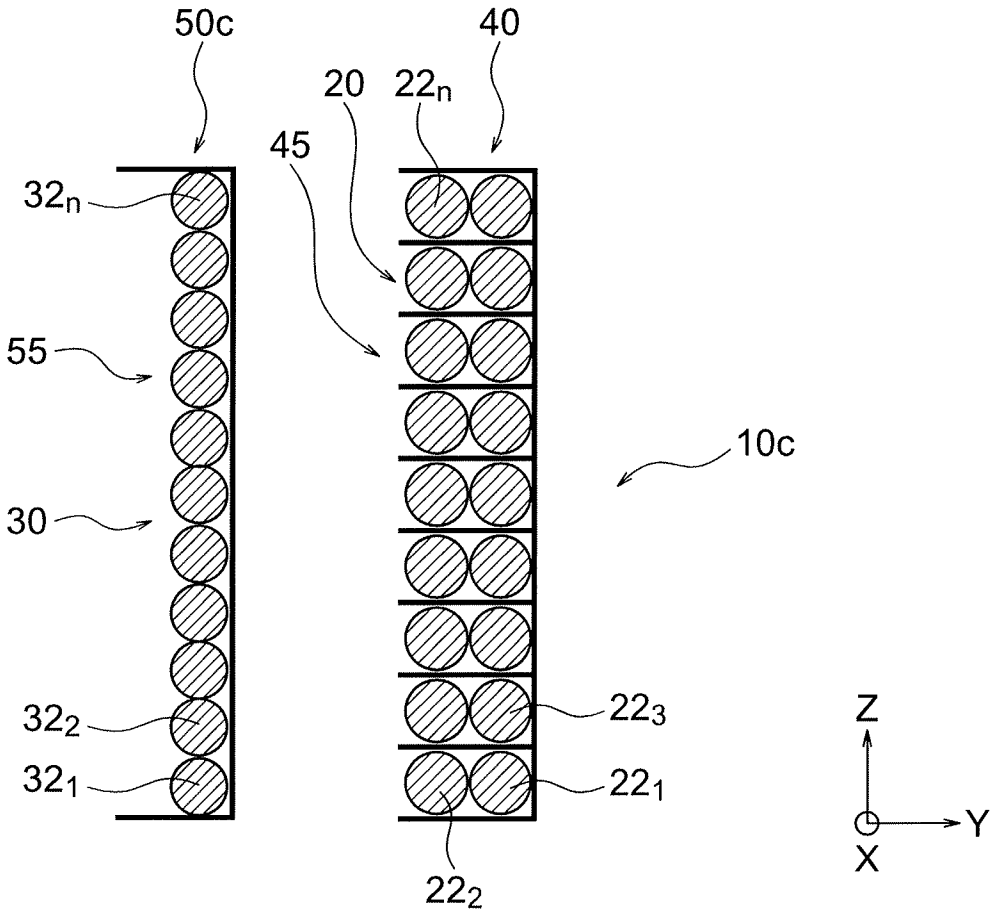
FIG. 9B is a schematic view showing the relation between a primary coil and a secondary coil of coil device according to another embodiments of the present invention.

Further, as with the coil device 10*c* shown in FIG. 9B, the leakage characteristics may be adjusted by making the number of winding layers of the first winding part 45 and the second winding part 55 different, even if making their overall widths the same. For the coil device 10*c* shown in FIG. 9B, compared with the coil device according to the first embodiment shown in FIGS. 1 to 6, the length of the second bobbin 50*c* in a direction of the scroll axis differs and the number of winding layers of the second wire 32 differs. For the others, they are the same.

Figure 9C:
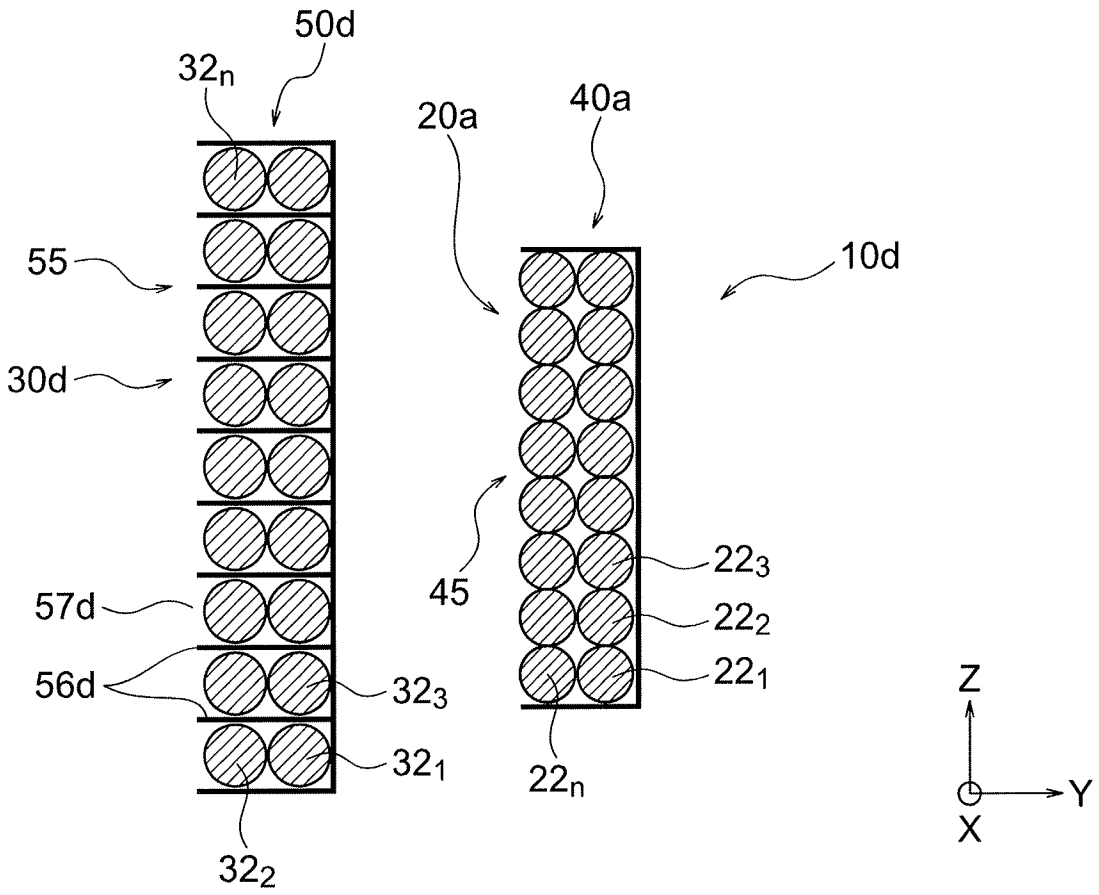
FIG. 9C is a schematic view showing the relation between a primary coil and a secondary coil of coil device according to another embodiments of the present invention.

For the coil device 10*d* shown in FIG. 9C, without forming partition walls 46 on the first bobbin 40*a*, the inner coil 20*a* which is formed on the first winding part 45 may serve as a primary coil of transformer, by having the first wire 22 ($\mathbf{22}_1$ to $\mathbf{22}_n$) wound by regular winding. In that case, on the second winding part 55 of the second bobbin 50*d*, partition walls 56*d* which are similar to the partition walls 46 of the first embodiment are formed. Further, for the winding method of the second wire 32 ($\mathbf{32}_1$ to $\mathbf{32}_n$) which composes the outer coil 30*d*, the same method with the first wire 22 of the first embodiment is applied. In this embodiment, the outer coil 30*d* composes a secondary coil of the transformer. For the other configuration and function effects, they are the same with the first embodiment.

Further, in the above-mentioned embodiment, it is not necessary to align the positions of the outer coil 30 and the inner coil 20 concentrically, and it may be displaced in order to adjust the leakage characteristics.

The invention claimed is:

1. A coil device comprising:

a first bobbin provided with a first winding part at an outer circumference to which a first wire comprising either a primary coil or a secondary coil is wound; and a second bobbin mounted on the outer circumference of said first bobbin and provided with a second winding part at an outer circumference to which a second wire comprising the other one of said primary coil or said secondary coil is wound, wherein a plurality of partition walls, separating the wires which are adjacent to each other along a scroll axis of said first wire or said second wire, are formed on said first winding part along said scroll axis at predetermined intervals, said scroll axis is arranged perpendicular to a mounting substrate surface, a first bobbin upper collar part is integrally formed on an upper side of a scroll axis direction of said first winding part to project from said first winding part in a radial direction, where a plurality of terminals are arranged on said first bobbin upper collar part, base portions of a core are arranged upward and downward directions of said scroll axis, a section width of each section, which is along said scroll axis and separated by said partition walls, is determined so that only one of said wire can pass through, a height of said partition walls is determined so that two or more of said wire can pass through in such a way that said wire can be wound in two or more layers, a height of said partition walls is higher than a value of m multiplied by d1, where "m" represents a total number of wire windings for each section and "d1" represents a wire diameter of said wire, a pair of first and second connecting grooves, connecting the sections which are adjacent to each other, are formed on both sides of each partition wall, said wire is wound in two or more layers in one section and then said wire is wound in two or more layers in a next section, and subsequently said wire is wound in two or more layers by moving said wire to another next section through the first connecting grooves, and a lead part of the first wire or the second wire, which is a start or final end of winding, passes through the second connecting groove, and the second connecting groove works as a path located inside of the second bobbin for leading the lead part to a terminal formed on the upper end of said scroll axis.

2. The coil device as set forth in claim 1, wherein the first wire arranged at an inner side of said second wire composes said secondary coil that produces a high voltage compared with said primary coil.

3. The coil device as set forth in claim 2, wherein the second wire is wound by normal regular windings around said second winding part.

4. The coil device as set forth in claim 1, wherein said second bobbin can be divided at a dividing line which is parallel to said scroll axis.

5. The coil device as set forth in claim 1, wherein a first overall width of said first winding part in a direction of said scroll axis is different from a second overall width of said second winding part in the direction of said scroll axis.

6. The coil device as set forth in claim 1, wherein said connecting grooves respectively formed on said partition walls, which are successive in a circumferential direction, are arranged so that they enable to communicate linearly along the direction of said scroll axis.

7. The coil device as set forth in claim 1, wherein at least one of said partition walls is contacted with the inner surface of said second bobbin so as to align said first winding part with said second winding part in a substantially concentric way.

8. The coil device as set forth in claim 1, wherein a longitudinal direction of the first bobbin and a longitudinal direction of the base portions of the core are perpendicular.

* * * * *